US005368176A

United States Patent [19]

Thanisch

[11] Patent Number: 5,368,176

[45] Date of Patent: Nov. 29, 1994

[54] CLOSURE WITH SNAP HINGE

[75] Inventor: Klaus Thanisch, Bullay, Germany

[73] Assignee: Zeller Plastik GmbH, Zell, Germany

[21] Appl. No.: 761,350

[22] PCT Filed: Feb. 28, 1990

[86] PCT No.: PCT/EP90/00327

§ 371 Date: Oct. 28, 1991

§ 102(e) Date: Oct. 28, 1991

[87] PCT Pub. No.: WO90/09931

PCT Pub. Date: Sep. 7, 1990

[30] Foreign Application Priority Data

Mar. 2, 1989 [DE] Germany ..... 3906570

[51] Int. Cl.[5] ..... B65D 47/08

[52] U.S. Cl. ..... 215/235; 220/335; 220/339; 222/556

[58] Field of Search ..... 215/235, 237; 220/259, 220/334, 337, 339, 335; 222/546, 556

[56] References Cited

U.S. PATENT DOCUMENTS

| | | | |
|---|---|---|---|
| 4,386,714 | 6/1983 | Roberto et al. | 220/339 |
| 4,487,324 | 12/1984 | Ostrowsky | 215/253 |
| 4,533,058 | 8/1985 | Uhlig | 215/216 |
| 4,773,550 | 9/1988 | Ekkert | 215/206 |
| 4,778,071 | 10/1988 | Fillmore | 215/237 |
| 4,795,043 | 1/1989 | Odet et al. | 215/235 |
| 4,813,560 | 3/1989 | Begley | 215/235 |
| 4,848,612 | 7/1989 | Beck | 215/235 |
| 5,123,561 | 6/1992 | Gross | 220/254 |
| 5,127,537 | 7/1992 | Graham | 220/339 |
| 5,221,017 | 6/1993 | Cistone et al. | 215/235 |

FOREIGN PATENT DOCUMENTS

| | | |
|---|---|---|
| 2755136 | 6/1978 | Germany . |
| 8705035 | 4/1980 | Germany . |

*Primary Examiner*—Allan N. Shoap
*Assistant Examiner*—Vanessa Caretto
*Attorney, Agent, or Firm*—Kane, Dalsimer, Sullivan, Kurucz, Levy, Eisele & Richard

[57] ABSTRACT

A snap hinge closure has a lid which pivots about a main axis of rotation with film hinges aligned therewith. When the lid is closed, no parts of the hinge project beyond the surfaces of the closure.

9 Claims, 4 Drawing Sheets

CLOSURE WITH SNAP HINGE

BACKGROUND OF THE INVENTION

Field of the Invention

The present invention relates to a closure comprising a snap hinge serving to connect the lower part of such closure to its lid.

Closures of the above-mentioned kind are known in the art. U.S. Pat. No. 4,487,324 OSTROWSKY/SEAQUIST, for example, discloses a closure having a snap hinge whereby two film hinges, lying in the main axis of rotation, are arranged on either side of a single spring element (hereinafter called "elastic" element). In contrast, DE-GMS 87 05 035—WEENER PLASTIK discloses a closure comprising an opposite arrangement of the snap hinge, wherein two elastic elements are arranged on either side of a single film hinge.

The concept of "surrounding border" is intended to embrace borders that do not completely run around the edge of the lid.

In both of the above named patents and particularly in the U.S. patent, parts of the lower part and lid, which are connected together by means of the film hinges, project relatively far outside of the closure. This results from the fact that both lower part and lid are, when being moulded, positioned relative to each other as indicated in FIG. 5 of the U.S. patent. Since, however, the mould for the lower part and lid have a specific wall thickness, the state of the art contemplated only the need to bridge such mould wall thicknesses by means of the sections that lead from both lower part and lid to the film hinge.

The same applies to U.S. Pat. No. 3,628,215—EVERBURG/AMERICAN OPTICAL—although the bridging sections, which had to exist due to the thicknesses of the mould wall, were not shown in all of the figures.

SUMMARY OF THE INVENTION

The present invention relates, therefore, to closures having a particularly attractive appearance, an aspect which requires, among other things, that the external profile of the elastic element, when the closure is in the closed position, so correspond to the external profile of adjacent sections of lower part and lid, that, ideally, a smooth, continuous external surface is formed, in contrast to U.S. Pat. No. 3,628,215—EVERBURG/AMERICAN OPTICAL, wherein the elastic element occupies the inside of the container when the lid is closed, the result of which being an aesthetically unpleasing groove that is visible from the outside.

Accordingly, the invention contemplates a small strip or two or more film hinge-strips, which are aligned with each other, serve as the film hinge.

The object of the present invention is the design of a closure wherein the film hinge, which lies in the main axis of rotation, cannot project to the outside when the closure is closed, a condition that applies equally when two or more film hinges are aligned in the main axis of rotation. It is proposed that a closure as described be so designed that, when the lid is closed, no part of the small strip is capable of projecting toward the outside. It is furthermore proposed that the closure comprising lid, lower part and hinge, nevertheless admit production in one moulding step.

In accordance with the invention, a single film hinge lies substantially in the outer faces of lower part and lid. In addition, two or more hinges, which are aligned together, are situated in flat sections of the outer faces of lower part and lid, that are located in the region of the hinge. In accordance with another aspect of the invention, the edges of the small strip or aligned small strips are also arranged in this manner.

It is proposed that, when the container is closed, no component or part of the small strip(s) which lead to the film hinge(s), will be able to protrude toward the outside. This advantage is enabled because sections of the lower part and the lid, which lead to the film hinge or film hinges, comprise inclined surfaces (bevelled edges). The inclination of the latter must be such that such edges are adjacent when the lid is closed and swung apart when the lid is opened.

In contrast to FIG. 5 of OSTROWSKY/SEAQUIST, the proposed design enables, when the lid is opened, the part of the articulated lid floor situated in the region of the film hinge to swing above the main axis of rotation. If the lid floor is flat or curved inwardly, the entire lid can be swung up over the main axis of rotation. Consequently, the lower part and the lid can be moulded in a mould that has no separation wall or walls between lower part and lid. These advantages will be described in the following disclosure with the aid of figures.

The expression "above" used herein relates to the closure when aligned vertically, for example, aligned uprightly over the mouth of a bottle.

If the bevelled edges rest on top of each other when in the closed position, the exact and correct positioning of the film hinge or film hinges, even when embodied as small strips, is ensured when the lid is in the closed position. Despite unavoidable play, the film hinge or film hinges are, when the bevelled edges are pressed together, positioned at the corner located between the outer faces of both lower part and lid. When the container is being closed, the small strips are completely pulled toward the inside, and are thus prevented from protruding even partially toward the outside.

The bevelled edges can be flat. However, such bevelled edges can have matching curvatures.

Steps arranged inside the bevelled edges, allow one of the parts (lower part or lid) during closure to pull the other part into its correct position. The steps in this embodiment are so designed that the part having the host stable construction will pull the other part into its correct position.

The above-mentioned steps can be formed by a raised section located on the bevelled edge of the lid and a recessed section located on the bevelled edge of the lower part, the effect of which being that, when the lid is snapped shut, the latter is pulled toward the inside relative to the rear wall of the lower part.

If the film hinge is constructed as a small strip, which is useful in the operation of some embodiments of the present invention, the entire width of the small strip will be pulled to the inside when the lid is closed, which prevents any part of the small strip from protruding to the outside when the closure is in the closed position.

Embodiment examples with further distinguishing features of the present invention will be described in greater detail with the aid of drawings.

DETAILED DESCRIPTION

Closures of the type contemplated in the present invention are produced from elastic synthetic material, preferably polypropylene, which exhibits the rigidity required for such hinges.

The expression "snap hinge" is intended to convey the concept that the lid must, when being opened or closed, be moved past a certain dead point and be able to snap on its own accord out of such dead point, which is situated at a point situated in the lid's slew path, into either the open position or closed position end then to remain in such position.

Figure 1:
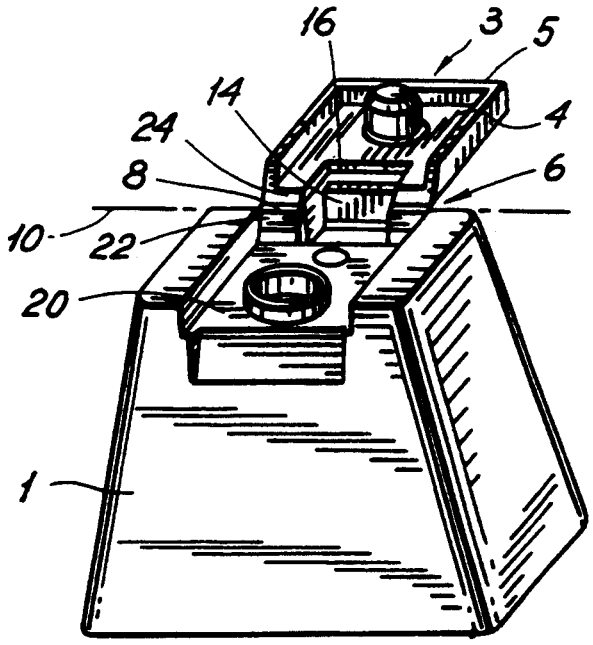
FIG. 1 shows a proposed closure in the open position.
Figure 2:
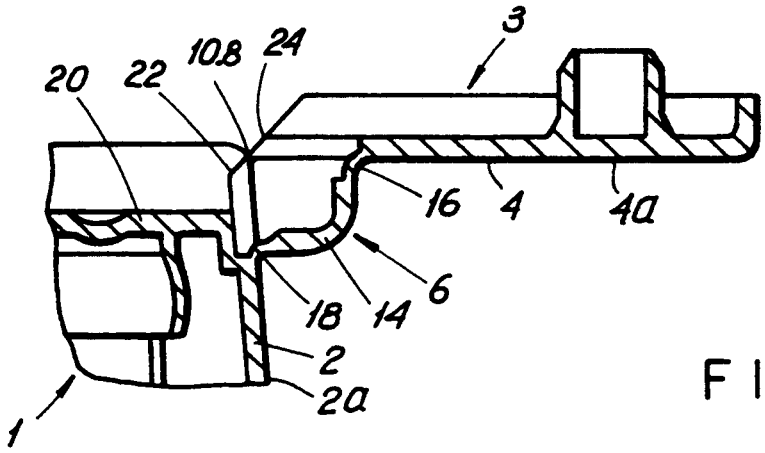
FIG. 2 shows a portion of a vertical cross section through the centre of a proposed closure and through the elastic element that is arranged in the middle thereof.

The closure illustrated in FIGS. 1 and 2 comprises a lower part 1 and a lid 3 which, as FIG. 1 shows, is surrounded on three sides by a border 5. Floor 4 of the lid connects via a snap hinge 6 to the rear wall 2 of the lower part. The snap hinge comprises two film hinges 8, which, lying to the outside, align with each other in a common main axis of rotation 10. Both lower part and lid have an indentation which, being located between the two film hinges 8, accommodates an elastic element 14 that connects via linear articulations 16 and 18 to floor 4 of the lid and rear wall 2 of the lower part respectively.

Lower part 1 comprises a flat rear wall 2 having an outer face 2*a* into which both film hinges 8 fall, while floor 4 of lid 3 has a flat outer face 4*a* into which both film hinges also fall. Outer faces 2*a* and 4*a* of rear wall and lid respectively also accommodate linear articulations 16 and 18, which have the same design as the film hinges but which are, for the purpose of being distinguished from the film hinges that sit in the main axis of rotation, named "linear articulations".

Figure 3:
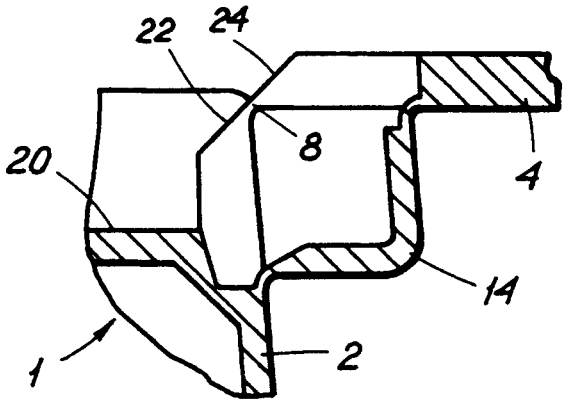
FIG. 3 shows a portion of the cross section of a snap hinge of a further embodiment of the proposed closure.
Figure 1A:
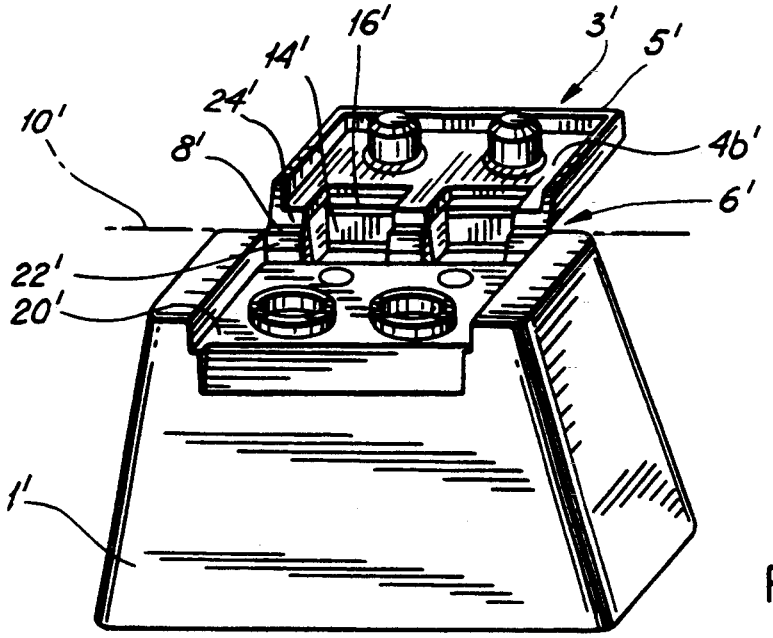

Rear wall 2 of the lower part extends on either side of elastic element 14 upwardly beyond floor 20 of the lower part and ends in inclined faces 22 whose arrangement is such that their upper edge, which lies in outer face 2*a*, coincides with the position of film hinge 8. Bevelled edge 24 of floor 4 of the lid is so arranged that its leading edge (pointing to the left in FIG. 2) lies in outer face 4*a* of the lid floor and also coincides with the position of film hinge 8. A variety of conventional embodiments can be contemplated for film hinge or film hinges 8. The latter can be embodied as a thin notch or as a narrow strip; their inner and/or outer faces can be so curved that the convex side of the bend as shown in FIG. 2 or 3 faces left toward the top. The inclined surface shown in FIG. 3, which is formed by the two bevelled edges 22 and 24, can feature between such bevelled edges a groove which acts as a weakened zone.

Elastic element 14 can, depending on the external profile of the closure, have a curvature, (FIG. 2) or be angular (FIG. 3). The size of the angle can range from 60° to approximately 120°. It is essential in any case, however, that the design of lower part, lid and elastic element be such that the injection mould need not have a separation wall or separation walls between lower part 1 and lid 3 and that the moulded closure can, following the injection moulding process, be removed without difficulty in a more or less vertical direction from the mould, as suggested by FIG. 2.

This can be achieved in particular if both lid and lower part have bevelled edges arranged as described above. One consequence of this arrangement is that, for example, a lid having a flat floor 4 as shown in FIGS. 1 or 2 as well as a lid having an inwardly curved floor lies, when in the open position, above the main axis of rotation 10, while similar prior art lids are forced to lie at least partially below the film hinge.

Figure 4:
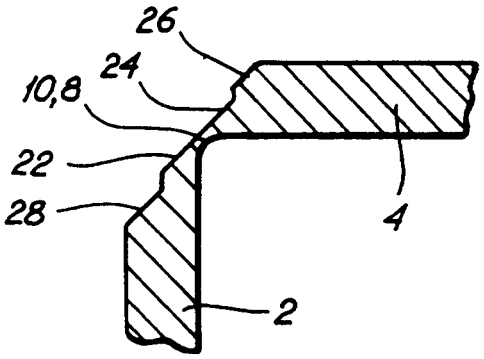
FIG. 4 shows with the lid in the open position, a cross section at right angles to the main axis of rotation through a section of the lower part and lid having bevelled edges comprising mating steps.

FIG. 4 illustrates a special embodiment of both inclined surfaces. The latter comprise, in the rear wall 2 and in floor 4 of the lid, steps whose shapes complement each other. Provided on the lid is a raised section 26, whose profile suggests a step that rises at an obtuse angle from bevelled edge 24. Provided on lower part 2 is a recessed section 28 which, in similar fashion, meets bevelled edge 22 at an obtuse angle and is thus able to mate with raised section 26.

Figure 5:
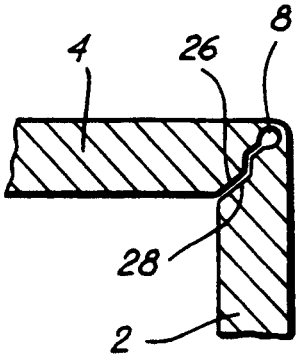
FIG. 5 shows the object of FIG. 4 in the closed position.

When the lid is closed, raised section 26 mates with recessed section 28 in such a manner that the step faces, whereat both sections merge with the bevelled surfaces and which are shown oriented vertically in FIG. 5, are able to come to rest against each other. By this means, the lid is pulled toward the inside, which prevents any part of film hinge 8 from protruding toward the outside.

Figure 6:
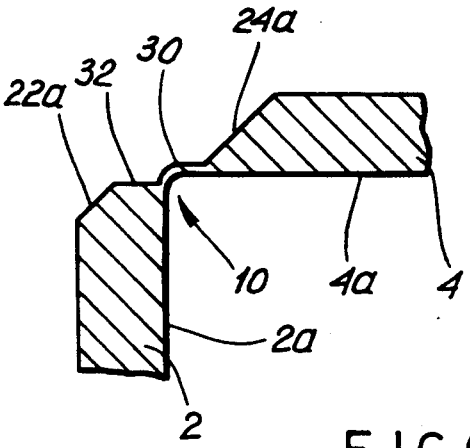
FIG. 6 shows a cross section of the open closure showing sections of the lower part and lid, which are connected together by means of a film hinge embodied as a small strip.
Figure 7:
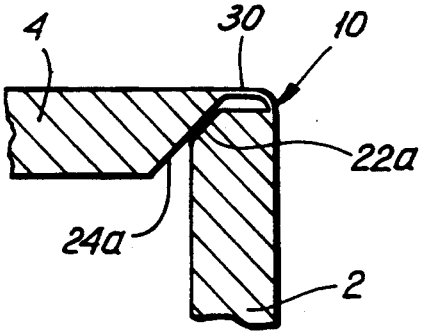
FIG. 7 shows the object of FIG. 6, in the closed position.
Figure 4A:
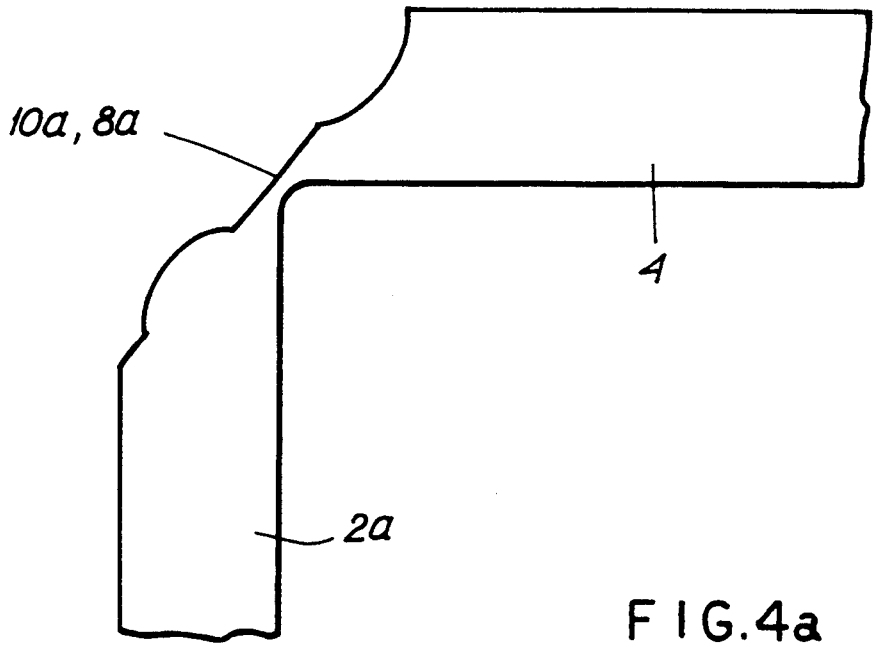
Figure 5A:
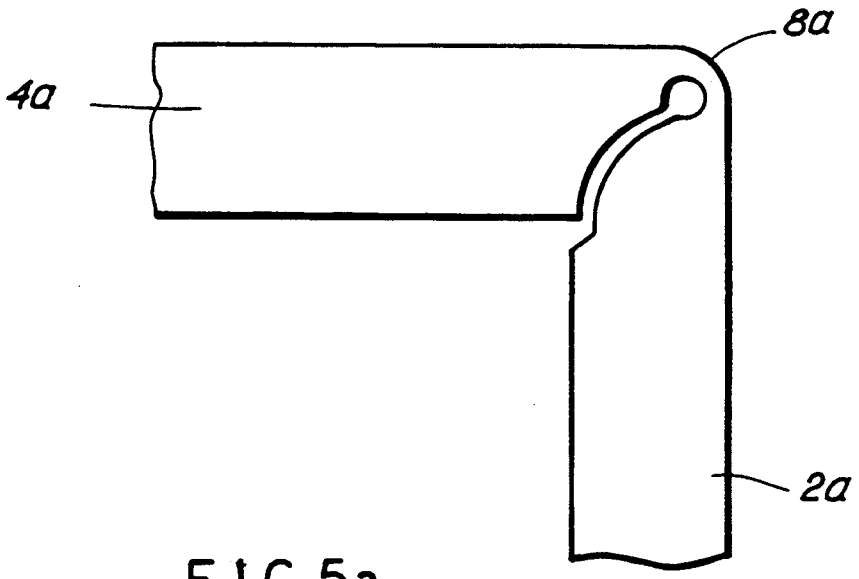

As FIGS. 6 and 7 show, the film hinge can also be embodied as a small strip 30. It must be ensured that the main axis of rotation 10 occupy a point (identified in the figure by a cross) and lie within a region of play at one of the edges of the small strip. This can be accomplished if the lid, as is also shown in FIGS 2 and 3, have across practically its entire thickness (more particularly over its thickness minus the thickness of the small strip) a bevelled edge 24*a*. In contrast, rear wall 2 of the lower part has only a shortened bevelled edge 22*a*, which is situated on the inner side of the rear wall, as well as a rim surface 32 that runs at an angle to the rear wall. The left-hand edge of the small strip meets the corner formed at the junction of rim surface 32 and outer face 2*a* of the rear wall. The right-hand edge of the small strip indicated in FIG. 6 joins outer face 4*a* of the lid floor as well as the lower extremity of bevelled edge 24*a*. When the lid is closed, bevelled edges 22*a* and 24*a* come to rest against each other (FIG. 7) which enables small strip 30 to be pulled completely inward, the result of which being that no portion of the small strip can protrude toward the outside when the lid is in the closed position.

Figure 8:
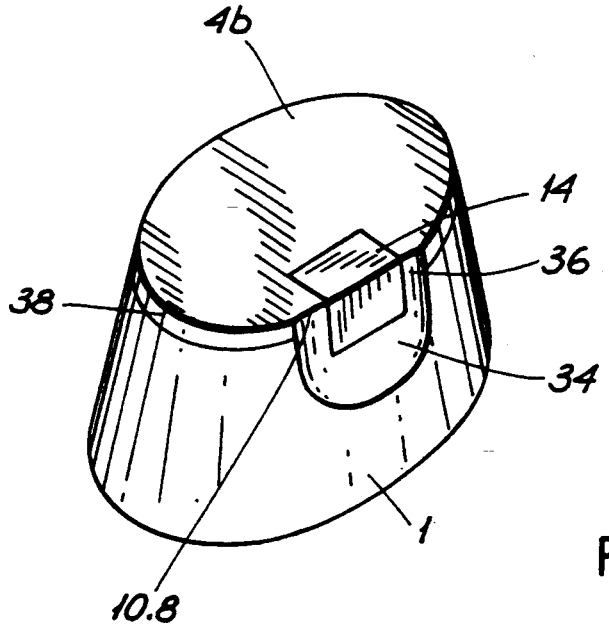
FIGS. 8 and 9 are perspective views of the proposed closure in both the closed and open positions wherein the lower part and lid have, up to sections located in the region of the hinge, the shape of cones having elliptical cross sections.
Figure 9:
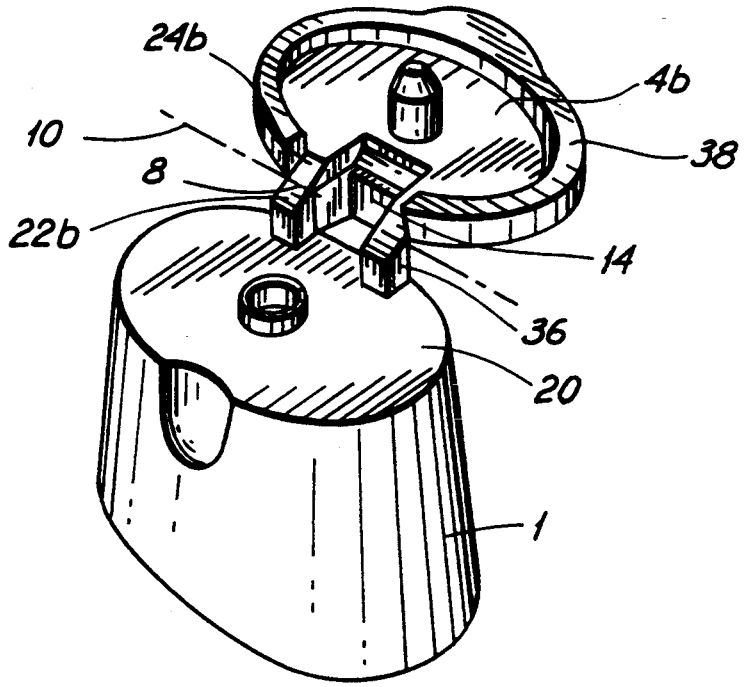

As FIGS. 8 and 9 show, the present invention can be used in conjunction with closures comprising curved external walls and shaped as a cone having elliptical cross sections. It is, however, essential that the lower part comprise in the region of the hinge a flattened section 34 whose width is at least as great as the integral length of the hinge in the direction of the main axis of rotation 10. Projecting upwardly from floor 20 of the lower part are two protrusions 36, each of which comprises a bevelled face **22*b*, of the kind described above, both of which connect to a bevelled face 24*b* of the lid via a film hinge 8 which sits in the main axis of rotation 10. Bevelled faces 24*b* extend across the entire thickness of lid floor 4*b* in a fashion analogous to that shown in FIG. 3. Floor 4*b* of the lid has, up to the longitudinal extremities of the hinge, a surrounding border 38. When the lid is closed, as in FIG. 8, the lower edge of border 38 comes to rest on top of floor 20 of the lower part, while bevelled faces 22*b* and 24*b*** come to lie against each other.

Inclined faces 22 and 24 can, as is shown particularly well in FIG. 3, be flat. They can also be curved, which is to say, have jacket surfaces that are parallel to the main axis of rotation. It is preferable that such curvatures mate together when the lid is closed.

The present invention can also be used in conjunction with closures wherein only a single film hinge is arranged in the middle of the closure and is flanked by two elastic elements.

The present invention can also be used in conjunction with arrangements wherein more than two elastic elements and/or film hinges are arranged side by side in the main axis of rotation, an arrangement which, for example, can be essential in the design of box-shaped containers.

The closures can, if required, also be moulded conventionally by using dies or pushers and then be removed from the mould in a suitable manner.

I claim:

1. A closure having an open and closed position comprising the following components:

a) a lower part (1) connecting via a snap hinge (6) defining a main axis of rotation to a lid (3) having a floor (4) and provided with a surrounding border (5, 38), the lower part and lid having adjacent portions, outer faces (**2*a*, 4*a***) and contiguously lying sections and possessing an external profile;

b) the snap hinge and at least the contiguously lying sections of said lower part and said lid are produced in one piece from synthetic material;

c) the snap hinge has, for the purpose of directly connecting the lower part to the lid in the main axis of rotation (10), at least one film hinge (8);

d) a plurality of linear articulations (16, 18) are oriented parallel to and are separated from the main axis of rotation (10);

e) the snap hinge has at least one elastic element (14) which, in the closed position, lies inside the external profile of the adjacent portions of said lower part (1) and said lid (3) and is connected via linear articulations (16, 18), to said lid (3) and said lower part (1);

whereby f) a single film hinge (8) lies substantially in said outer faces (**2*a*, 4*a***) of said lower part and said lid;

g) the sections of the lower part and lid which connect directly to at least one film hinge (8) comprise bevelled edges that run at an angle to the outer faces and which when closed, are adjacent to each other and when open are swung apart from each other;

h) when the lid is open, said floor (4) of the lid is aligned with the film hinge (8) above the main axis of rotation of the lid.

2. A closure having an open and closed position comprising the following components:

a) a lower part (1) connects via a snap hinge (6) defining a main axis of rotation to a lid (3) having a floor (4) and comprising a surrounding border (5, 38), the lower part and said lid having adjacently lying sections, outer faces (**2*a*, 4*a***), and possessing an external profile;

b) the snap hinge and at least the adjacently lying sections of said lower part and said lid are produced in one piece from synthetic material;

c) the snap hinge has, for the purpose of directly connecting the lower part to the lid, a small strip (30) acting as the film hinge;

d) a plurality of articulations (16, 18) oriented parallel to and are separated from the main axis of rotation 10;

e) the snap hinge has at least one elastic element (14) which, when in the closed position, lies inside the external profile of the adjacent sections of said lower part (1) and said lid (3) and is connected to said lid (3) and said lower part (1) via linear articulations (16, 18);

whereby:

f) the edges of a single small strip (30) lie essentially in said outer faces (**2*a*, 4*a***) of said lower part and said lid;

g) the sections of said lower part and said lid that connect directly with at least one small strip (30) have bevelled edges (**22*a*, 24*a***) that run at an angle to the outer faces and which, when in the closed position, are adjacent to each other and when in the open position, are swung apart from each other;

h) said floor (4) of the lid is, when the lid is open, aligned with film hinge (8) above the main axis of rotation of the lid.

3. The closure in accordance with claim 1 or 2, whereby said bevelled edges (22, 24) lie against each other when in the closed position.

4. The closure in accordance with claim 3, whereby the bevelled edges (22, 24) are flat.

5. The closure in accordance with claim 1 or 2, whereby the bevelled edges have mating curvatures that mate with each other and have jacket surfaces that run parallel to the main axis of rotation.

6. The closure in accordance with claim 1, whereby:

a) said bevelled edges (22, 24) of said lower part and said lid have steps oriented parallel to the main axis of rotation and which, in the closed position, mate with each other in a hooklike fashion;

b) the orientation of the steps is such that, when in the closed position, the step of the part whose construction is the more stable (either lower part or lid) pulls the part which is less structurally stable away from the main axis of rotation.

7. The closure in accordance with claim 6, whereby:

a) said bevelled edge (24) forms a step on the side facing away from the main axis of rotation (10) a raised section (26);

b) in order to mate with which, said bevelled edge (22) of the lower part has, for the purpose of forming a step, a recessed section (28).

8. The closure in accordance with claim 7, whereby said raised and recessed sections (26, 28) merge with the bevelled edges at an obtuse angle.

9. The closure in accordance with claim 2, whereby:

a) said bevelled edge (24*a*) of the lid extends over the integral thickness of the lid floor (4) minus the thickness of the small strip (30);

b) said bevelled edge (22*a*) of the lower part extends only over a portion of the thickness of a rear wall (2), on an inner side of the lower part and merges with a rim surface (32) that runs at about right angles up to the rear wall;

c) in such a way that, when the lid is being closed, the small strip is pulled inwardly over the rim surface (32).

* * * * *

UNITED STATES PATENT AND TRADEMARK OFFICE

CERTIFICATE OF CORRECTION

PATENT NO. : 5,368,176

DATED : November 29, 1994

INVENTOR(S) : Klaus Thanisch

It is certified that error appears in the above-indentified patent and that said Letters Patent is hereby corrected as shown below:

Column 1, between lines 8 and 9 insert --Description of Related Art--

Column 3, line 33 change "end" to --and--

Signed and Sealed this

Eleventh Day of July, 1995

*Attest:*

Bruce Lehman

BRUCE LEHMAN

*Attesting Officer*

*Commissioner of Patents and Trademarks*